United States Patent [19]

Ross

[11] 4,023,992

[45] May 17, 1977

[54] URANIUM-BASE ALLOYS

[75] Inventor: Alan Malcolm Ross, Deep River, Canada

[73] Assignee: Atomic Energy of Canada Limited, Ottawa, Canada

[22] Filed: May 30, 1974

[21] Appl. No.: 474,412

[30] Foreign Application Priority Data

June 28, 1973 Canada ..... 175142

[52] U.S. Cl. ..... 148/132; 75/122.7

[51] Int. Cl.[2] ..... C21D 1/00; C22C 28/00

[58] Field of Search ..... 75/122.7; 148/132

[56] References Cited

UNITED STATES PATENTS 3,717,454 2/1973 Wyatt ..... 75/122.7

*Primary Examiner*—Richard E. Schafer

*Attorney, Agent, or Firm*—Alan A. Thomson

[57] ABSTRACT

Uranium-base alloys suitable as nuclear fuel containing about 3.2 to 3.7 wt.% Si, from about 0.8 up to about 3 wt.% Al and the balance U except that when the Al content is not more than 1.5% the Si content is less than 3.5%. The major phase is delta $U_3Si$ containing about 0.5 wt.% of dissolved Al. A method of optimizing the corrosion resistance is also specified.

8 Claims, No Drawings

URANIUM-BASE ALLOYS

This invention is concerned with uranium-base alloys suitable for use as nuclear fuel and to a method of preparing such alloys having a desired microstructure.

The use of delta phase uranium-silicon alloy ($U_3Si$) as a nuclear fuel in water-cooled reactors will require that the alloy have good aqueous corrosion resistance at temperatures up to about 820 K (≈550° C), typically the maximum fuel temperature in an operating fuel element containing this alloy.

Previously (U.S. Pat. No. 3,717,454 Feb. 20, 1973 Wyatt), adequate aqueous corrosion resistance at up to about 570 K (≈300° C) was claimed for ternary alloys of uranium-siliconaluminum containing up to 1.5 wt.% Al, and amounts of silicon, (specified as 3.5–3.7 wt.% Si) so that, on annealing to form the delta ($U_3Si$) phase, no free uranium phase remained. However, the aqueous corrosion resistance of these alloys at up to 820 K was not investigated.

I have now found that of the above ternary alloys (U-Si-Al), those containing less than about 0.8 wt.% Al do not have adequate aqueous corrosion resistance at 820 K, and that to achieve this desirable corrosion resistance it is necessary to maintain the aluminum content of these ternary alloys at above about 0.8 wt.%. As the Al concentration decreases from 1 to 0.5% the high temperature corrosion resistance decreases and below about 0.8% is considered to be unacceptable. Further, the melting and casting conditions for these ternary alloys must be carefully controlled to ensure a fine microstructure in the as-cast alloys. Only then can the as-cast alloys be satisfactorily transformed by heat treatment to the delta phase which possesses adequate aqueous corrosion resistance at both 570 and 820 K. Finally, the compositions of these ternary alloys can be extended beyond those found useful previously by Wyatt to include aluminum contents up to about 3 wt.% and silicon contents down to about 3.2 wt.%. without loss of the good aqueous corrosion resistance required at 570 and at 820 K.

Alloys within the scope of this invention have from about 3.2 to 3.7 wt.% Si, from about 0.8 up to 3 wt.% Al and the balance uranium (except for impurities) except that when the Al content is not more than 1.5% the Si content is less than 3.5%. With less silicon than 3.2 wt.%, free uranium will remain in alloys containing 0.8–1 wt.% Al, and the aqueous corrosion resistance suffers. (With more silicon than about 3.7%, the U density suffers). Although aluminum may be added to remove the free uranium as the $UAl_2$ phase, the addition of aluminum lowers the density of the ternary alloy so produced, thus reducing the uranium density and the effectiveness of the alloy as a nuclear fuel. (Thus more than about 3% Al is not operative in this context). Preferred ranges according to this invention are 3.2 to 3.5 wt.% Si and from 1 to 3 wt.% Al. Within these ranges, the total silicon plus aluminum content is sufficient to combine with all of the U metal phase during heat treatment to provide a 3-phase ternary U-Si-Al alloy consisting of delta phase $U_3Si$ containing approximately 0.5 wt.% of dissolved aluminum, $U_3Si_2$ and $UAl_2$.

Casting of the molten ternary alloy should preferably be into small-bore, thick-wall copper or graphite molds of high heat capacity. Other means of casting may be used to promote rapid chilling of the cast alloy and to thus ensure a fine microstructure on solidification. The casting should be under non-oxidizing conditions at about 1770 to 1870 K (about 1500° to 1600° C). Heat treatment is necessary to convert the mixture of U-rich eutectic, $U_3Si_2$ and $UAl_2$ in the as-cast alloys to the required mixture of delta phase $U_3$ Si (plus dissolved aluminum), $U_3Si_2$ and $UAl_2$; the exact minor amounts of the latter two phases present in the heat-treated alloy are determined directly by the silicon and aluminum contents in the alloy which are in excess of the requirements of the $U_3Si$ phase. The heat treatment temperature should be near 1070–1120 K (800°–850° C), and the heat treatment carried out under nonoxidizing conditions and continued until complete transformation of the as-cast mixture to the above mixture of delta phase $U_3Si$ (plus dissolved Al), $U_3Si_2$ and $UAl_2$ has occurred, usually after about 72 hours (preferably under substantial vacuum conditions).

The following Examples are illustrative.

EXAMPLE 1

The estimated liquidus temperatures for the following compositions in the U-Si-Al alloy system are as follows:

TABLE I

| Alloy Composition | | | Liquidus Temperature |
|---|---|---|---|
| U wt. % | Si wt. % | Al wt. % | K, (° C) |
| 96.0 | 3.5 | 0.5 | 1713, (1440) |
| 95.5 | 3.5 | 1.0 | 1673, (1400) |
| 95.0 | 3.5 | 1.5 | 1648, (1375) |
| 93.5 | 3.5 | 3.0 | 1578, (1305) |
| 95.3 | 3.2 | 1.5 | 1613, (1340) |
| 93.8 | 3.2 | 3.0 | 1538, (1265) |

Consequently, these alloys can be produced by induction melting in a high frequency furnace under a slight positive pressure of inert gas (e.g., argon) to avoid loss of aluminum from the melt. Six alloys of the compositions defined were prepared. The U and Si were added either as $U_3Si$ alloy lumps or as pure U and Si lumps. Al was added as the virgin metal. Zirconia crucibles were used to contain the melt, first at temperatures near 1873 K (1600° C) to ensure proper mixing of the constituents, and then at 1773 K (1500° C) or lower just prior to casting the melt into a graphite or copper mold to form 15 mm diameter, 200 mm long cylindrical bars. larger blocks of graphite or copper to ensure rapid chilling of the cast bars and thus a fine as-cast microstructure. Casting was under substantial vacuum conditions. The castings were then heat-treated for 72 hours in vacuum at 1073 K (800° C) to convert the as-cast mixtures of U-rich eutectic (U-1.35 wt.% Si-0.65 wt.% Al), $U_3Si_2$ and $UAl_2$ to the delta phase $U_3Si$ plus 0.5 wt.% of dissolved Al, $U_3Si_2$ and $UAl_2$ (the amounts of the latter two phases depended on the Si and Al content of the alloy).

Metallographic, X-ray and electron microprobe examination of selected heat-treated alloys from Table I, showed that these consisted of small particles of $U_3Si_2$ and $UAl_2$ dispersed in a matrix of delta phase $U_3Si$ containing 0.5 wt.% of dissolved aluminum, and that no free uranium or uranium-rich phase was present. Theoretical densities for the heat-treated alloys were calculated, based on the X-ray densities for the $U_3Si$ (Al) delta phase (15.51 $Mg/m^3$), the $U_3Si_2$ phase (12.20 $Mg/m^3$) and the $UAl_2$ phase (8.14 $Mg/m^3$), and calculated volume fractions of the phases in each alloy. The calculated densities were in close agreement with the measured densities of the heat-treated alloys, and the volume fractions of the $U_3Si_2$ and $UAl_2$ phases observed in each alloy by metallography were also in close agreement with those calculated.

EXAMPLE 2

The aqueous corrosion resistance of the six heat-treated alloys of Table I, Example I above was determined at 573 K (300° C) and 823 K (550° C) and typical data are given in the following table: (TABLE II)

As Table II indicates, corrosion resistance for all alloys at both 573 and 823 K were satisfactory, except for the U-3.5 wt.% Si-0.5 wt.% Al alloy which corroded rapidly at 823 K. Other heat-treated U-Si-Al alloys having compositions near U-3.5 wt.% Si-0.5 wt.% Al were also corrosion tested and showed

TABLE II

| Alloy Composition | | Average Corrosion Rate kg/m² h | |
|---|---|---|---|
| Wt. % Si* | Wt. % Al* | at 573 K** | at 823 K*** |
| 3.5 | 0.5 | < 0.03 | 2 - 5 |
| 3.5 | 1.0 | < 0.03 | 0.02 - 0.12 |
| 3.5 | 1.5 | < 0.03 | 0.02 - 0.20 |
| 3.5 | 3.0 | < 0.03 | 0.02 - 0.03 |
| 3.2 | 1.5 | < 0.03 | 0.02 - 0.03 |
| 3.2 | 3.0 | < 0.03 | 0.02 - 0.03 |

*balance uranium
**in water pressurized at 7MN/m² (70 atmospheres) ≥5 hours exposure.
***in flowing steam at 0.1 MN/m² (1 atmosphere) ≥2 hours exposure.
(MN = mega ($10^6$) Newtons)

rapid aqueous corrosion rates at 823 K, typically 2 to 7 kg/m²h. Provided aluminum contents were equal to or greater than about 1 wt.%, heat-treated U-Si-Al alloys containing about 3.2 to 3.5 wt% Si showed aqueous corrosion rates at either 573 or 823 K that were ≤ 0.03 kg/m²h. Considering the amounts of Al required to form the 0.5% solution in $U_3Si$ and to form the $UAl_2$ phase, acceptable corrosion resistance should be obtained with at least about 0.8% Al.

EXAMPLE 3

Several heat-treated rods of the (a) U-3.5 wt.% Si-1.5 wt.% Al and (b) U-3.2 wt.% Si-2.5 wt.% Al alloys were irradiate in a nuclear reactor to burnups between 420 and 620 MWh/kg U (17,500 - 25,800 MWd/tonne U). The fuel elements containing these alloys showed dimensional stability as good as those which contain binary delta phase $U_3$ Si irradiated to similar burnups under similar conditions.

The benefits of the invention are obtained with only a small increase in competitive neutro absorbtion by the alloying elements, aluminum and silicon.

I claim:

1. Uranium alloys consisting essentially of from about 3.2 to about 3.7 wt.% silicon, from about 0.8 to about 3 wt.% aluminum, and the balance uranium, except that when the aluminum content is not more than 1.5 wt.% the Si content is less than 3.5 wt.%.

2. The alloys of claim 1 wherein the silicon content is about 3.2 to 3.5 wt.%.

3. The alloys of claim 1 wherein the aluminum content is about 1.5 to 3 wt.%.

4. The alloys of claim 1 wherein the silicon content is 3.2 - 3.5 wt.% and the aluminum content is 1 - 3 wt.%.

5. The alloys of claim 1 wherein the structure consists essentially of $U_3Si$ containing about 0.5 wt.% of dissolved aluminum, a minor amount of the $UAl_2$ phase, and isolated small particles of $U_3Si_2$.

6. The alloys of claim 1 in the form of nuclear fuel rods.

7. A method of optimizing the aqueous corrosion resistance of the alloys of claim 1 comprising: casting the alloys from a melt under non-oxidizing conditions at about 1500° to 1600° C into thick-walled molds having a high heat capacity while rapidly cooling the cast alloy to give a fine microstructure; and heat-treating the cast alloy at about 800° to 850° C under non-oxidizing conditions until the alloy is substantially completely converted to delta phase $U_3Si$ containing about 0.5 wt.% of dissolved Al and minor amounts of the $U_3Si_2$ and $UAl_2$ phases.

8. A method as in claim 7 of optimizing the aqueous corrosion resistance of the alloys of claim 1 comprising: casting the alloys from a melt at about 1500° C under substantial vacuum conditions, to rapidly cool the cast alloy, and heat-treating the cast alloy at about 800° C for about 3 days under substantial vacuum conditions until the alloy is substantially completely converted to delta phase $U_3Si$ containing about 0.5 wt.% of dissolved Al and small amounts of the $U_3Si_2$ and $UAl_2$ phases.

* * * * *